US007684285B2

(12) United States Patent
Jeanneret

(10) Patent No.: US 7,684,285 B2
(45) Date of Patent: Mar. 23, 2010

(54) POWER RESERVE INDICATOR MECHANISM

(75) Inventor: Sébastien Jeanneret, Le Locle (CH)

(73) Assignee: Vaucher Manufacture Fleurier S.A., Fleurier (CH)

( * ) Notice: Subject to any disclaimer, the term of this patent is extended or adjusted under 35 U.S.C. 154(b) by 799 days.

(21) Appl. No.: 10/596,937

(22) PCT Filed: Jan. 7, 2005

(86) PCT No.: PCT/IB2005/000019

§ 371 (c)(1),
(2), (4) Date: Jun. 29, 2006

(87) PCT Pub. No.: WO2005/085963

PCT Pub. Date: Sep. 15, 2005

(65) Prior Publication Data

US 2009/0161495 A1 Jun. 25, 2009

(30) Foreign Application Priority Data

Feb. 4, 2004 (EP) ..... 04002419

(51) Int. Cl.
*G04B 9/00* (2006.01)
*G04B 1/10* (2006.01)

(52) U.S. Cl. ..... 368/66; 368/140; 368/210

(58) Field of Classification Search ..... 368/64, 368/66, 203, 140, 145–149, 206–210, 212
See application file for complete search history.

(56) References Cited

U.S. PATENT DOCUMENTS 5,699,322 A * 12/1997 Born ..... 368/66
5,828,628 A * 10/1998 Born et al. ..... 368/66
6,166,999 A * 12/2000 Jujo et al. ..... 368/66
6,340,241 B2 * 1/2002 Jeanneret ..... 368/210
6,685,352 B1 * 2/2004 Capt et al. ..... 368/206
6,805,482 B2 * 10/2004 Berard ..... 368/151
6,826,124 B2 * 11/2004 Born ..... 368/66
7,300,200 B2 * 11/2007 Suzuki ..... 368/212
7,357,568 B2 * 4/2008 Gerber et al. ..... 368/212

FOREIGN PATENT DOCUMENTS

EP 1139182 10/2001

OTHER PUBLICATIONS

B. Humbert: "La montre suisse a remontage automatique", 1955, Scriptar, Lausanne, XP002292231, cited in the application p. 85-p. 87.

* cited by examiner

*Primary Examiner*—Vit W Miska
(74) *Attorney, Agent, or Firm*—Young & Thompson

(57) ABSTRACT

The invention concerns a power reserve indicator mechanism for a timepiece of the type comprising:

a mainspring (14), a power reserve indicator moving between two end positions, a differential gear (18), and an intermediate wheel set (32) including first and second parts respectively kinematically coupled to the differential gear (18) and to the indicator and a coupling member coupling said parts, which rotate conjointly while the winding of the mainspring (14) is comprised between its end positions, Said coupling member includes a friction mechanism arranged such that the first part can move with friction in relation to the second when the indicator has reached its first end position, and an elastic element arranged so as to be able to be cocked when the indicator has reached its second end position, by the movement of the first part with reference to the second part.

16 Claims, 3 Drawing Sheets

POWER RESERVE INDICATOR MECHANISM

BACKGROUND OF THE INVENTION

The present invention relates to the field of horology. It concerns, more specifically, power reserve indicator mechanisms for a timepiece movement of the type fitted with an energy source formed of a mainspring. In a conventional manner, the mechanism according to the invention includes a frame, a power reserve indicator and a differential gear with a first input coupled to a wheel set driven in rotation when the mainspring is being wound and a second input coupled to a wheel set driven in rotation when the mainspring is let down, and an output coupled to the power reserve indicator. In such a mechanism, the indicator is able to cover a given angle comprised between two end positions, the first of which is occupied when the mainspring is wound and the second, when the spring is let down.

DESCRIPTION OF THE RELATED ART

A mechanism of this type is described in "La montre Suisse à remontage automatique" ("The automatically wound Swiss watch") by B. Humbert, Scriptar editions, Lausanne 1955, at page 85. It is fitted with an indicator friction mounted on a wheel set coupled to the output of the differential gear. The two end positions between which the indicator moves are defined by stop members. When the indicator reaches one of the stop members, at the upper winding or let down limit of the mainspring, it remains immobile whereas the mainspring continues to be wound or let down, the friction allowing the gear train to move while the indicator is still.

Such a solution thus enables the real winding of the mainspring to be estimated, but there may be significant differences from one cycle to another, due to the relative movement of the indicator in relation to the gear train.

In order to overcome this drawback, EP Patent Application No, 1 139 182 filed in the name of the Applicant, discloses a mechanism comprising an intermediate wheel set inserted between the output of the differential gear and the power reserve indicator. This wheel set includes an elastic element arranged such that the differential gear continues to rotate freely while the indicator remains abutting against the stop member or stopped, causing the elastic element to be cocked.

In practice, this arrangement can be used when the indicator is stopped in one or other of its end positions. But it is difficult to make the maximum winding position of the mainspring coincide perfectly with the end position of the indicator corresponding to the largest power reserve. This involves particular precautions and specific measures to be taken during assembly, particularly during after-sales service, for the indicator to display correct information.

SUMMARY OF THE INVENTION

It is an object of the present invention to overcome the aforementioned drawback, while keeping the advantages provided by the mechanism of the aforecited EP Patent.

More specifically, the invention concerns a power reserve indicator for a timepiece movement of the type comprising a frame, an energy source, formed by a barrel and a mainspring housed in the barrel, a going train driven by the barrel and means for winding the mainspring. This mechanism includes:

- a power reserve indicator with a wheel set and a display device carried by the wheel set,
- a differential gear kinematically coupled to the barrel via a first input, to the winding means via a second input and to the indicator via an output, and

- an intermediate wheel set comprising first and second parts respectively kinematically coupled to the output and to the intermediate wheel set of the indicator and a coupling member coupling such parts, arranged such that the indicator occupies a position comprised between two end positions, the first reached when the winding of the spring is greater than an upper threshold value, and the second when the winding of the spring is less than a lower threshold value, the first and second parts rotating conjointly while the winding of the spring is comprised between its extreme values.

According to the invention, the coupling member includes a friction mechanism arranged such that the first part can move with friction in relation to the second when the indicator has reached its first end position, and an elastic element arranged so as to be able to be cocked when the indicator has reached its second end position, by the movement of the first part in relation to the second part.

Advantageously, the friction mechanism includes a stop member secured to one of the parts and a lever friction mounted on the other part, disposed and sized such that:

- when the indicator occupies its first end position and the mainspring continues to be wound, the lever is held against the stop member and rotates with friction on the part to which it is secured, such that the indicator remains immobile, and
- as soon as the mainspring is let down, the indicator leaves its first end position, the first and second parts of the intermediate wheel set rotating together.

The lever is provided with a longitudinal slot enlarging into an aperture engaged on the pinion.

The elastic element is secured to the part including the stop member and cooperates with the lever such that, when the indicator occupies its second end position, it is immobilised, whereas the mainspring drives the going train and the differential gear, and that the elastic element is cocked, then let down when the mainspring is let down.

The mechanism further includes the following features:

- the elastic element is formed of an elastic strip fixed by a first of its ends to the wheel, whereas its second end, which is free, is disposed such that it presses the lever against the first end,
- the intermediate wheel set includes a wheel formed of a plate whose periphery is provided with a toothing, a pinion formed of a sleeve provided at one of its ends with a toothing, a spacer disposed on the sleeve, the lever being snap fitted onto the sleeve to hold said wheel which is mounted to rotate freely on the spacer, and
- the mainspring is of the slipping spring type.

BRIEF DESCRIPTION OF THE DRAWINGS

Other advantages of the description will appear more clearly upon reading the following description, made with reference to the annexed drawing, in which.

DETAILED DESCRIPTION OF THE PREFERRED EMBODIMENTS

Figure 1:
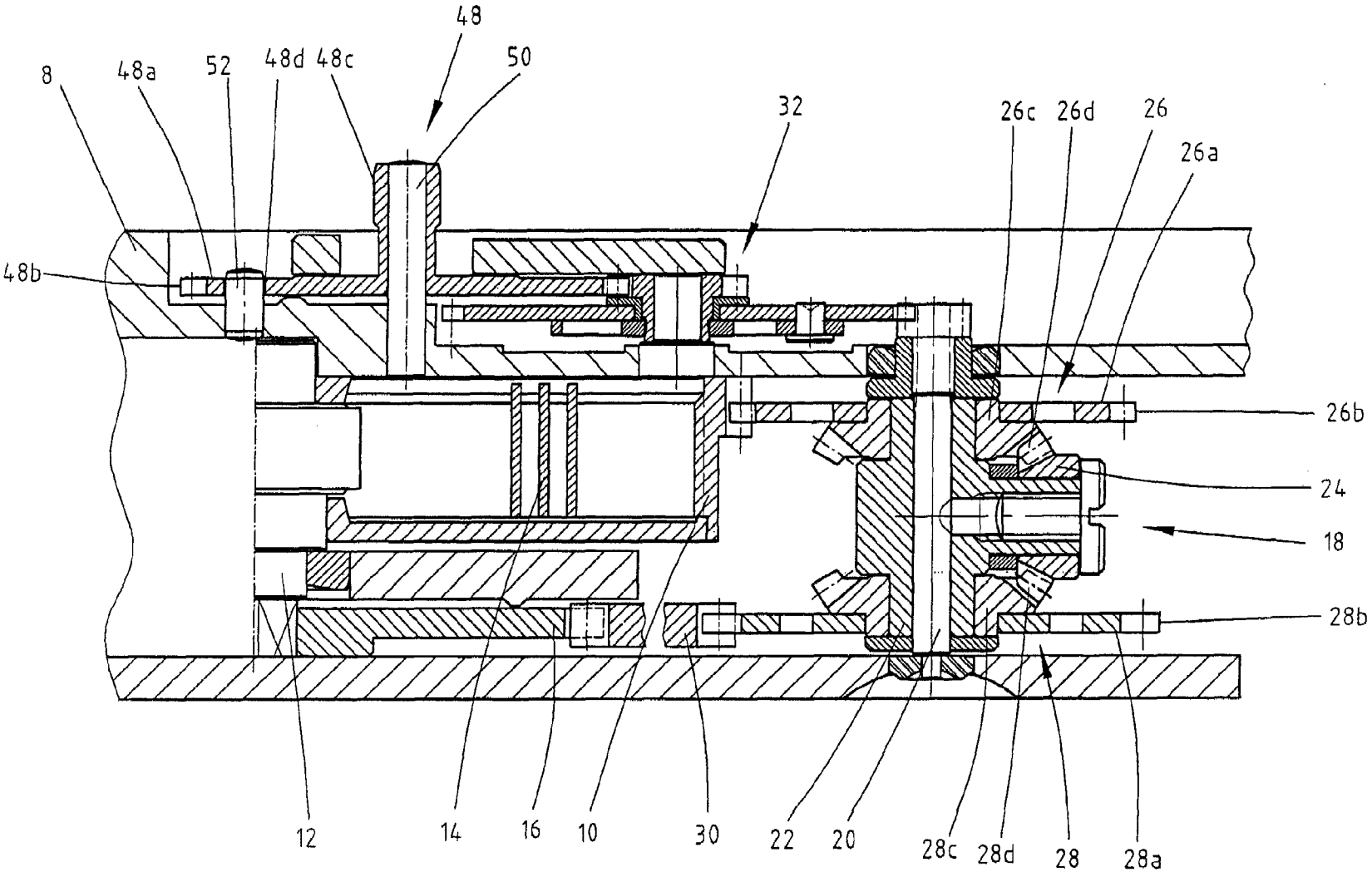
FIG. 1 is a cross-sectional view of a date indicator mechanism according to the invention.

The mechanism according to the invention is intended to be placed in a watch movement. It is mounted on a plate 8 that is partially visible in the drawing. The movement includes an energy source formed of a barrel 10, mobile in rotation about an arbour 12 pivoting on plate 8 and in which there is housed a mainspring 14 provided with a slipping spring, not explicitly shown in the drawing. Arbour 12 carries a ratchet wheel 16 which, driven in rotation by means of a winding crown that is not shown, winds mainspring 14.

Barrel 10 drives the going train which is also not shown in the drawing.

The mechanism further includes a differential gear 18, described in detail in the aforementioned EP Patent Application. In summary, it includes an arbour 20 placed at its output, a planet carrier 22 secured in rotation to arbour 20 and carrying a planet gear 24 with a conical toothing. A first and a second input are respectively formed by a first 26 and a second 28 wheel mounted freely on planet carrier 22.

Wheels 26 and 28 are each formed by a plate identified by the letter a and the periphery of which carries a toothing b, and a pinion c provided with a conical toothing d. Wheel 26 meshes, via its toothing 26*b*, with barrel 10. Wheel 28 meshes, via its toothing 28*b*, with an intermediate wheel 30 that itself meshes with ratchet wheel 16. Finally, toothings 26*d* of pinion 26*c* and 28*d* of pinion 28*c* are meshed with planet gear 24.

The gear ratios between barrel 10 and first input wheel 26, on the one hand, and ratchet wheel 16 and second input wheel 28, on the other hand, are equal, such that, for the same given angle traveled by barrel 10 and ratchet wheel 16, wheels 26 and 28 travel equal angles.

Figure 2:
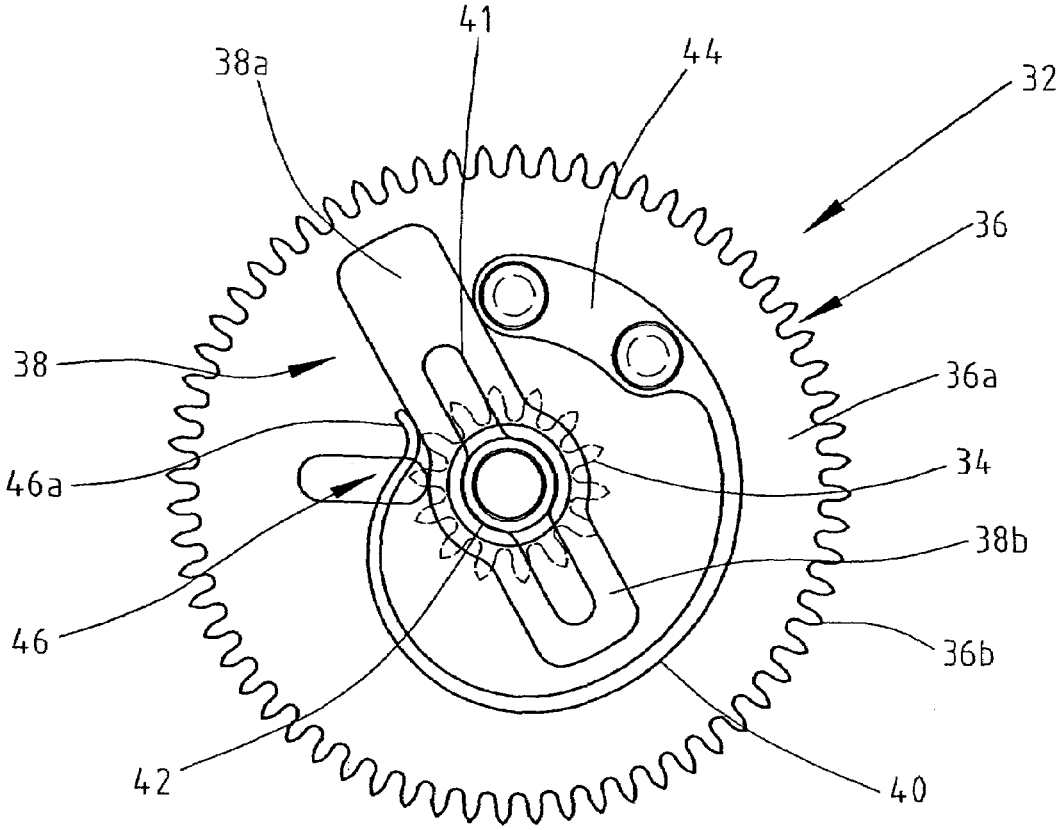
FIGS. 2 and 3 are top and cross-sectional views of the intermediate wheel set.
Figure 3:
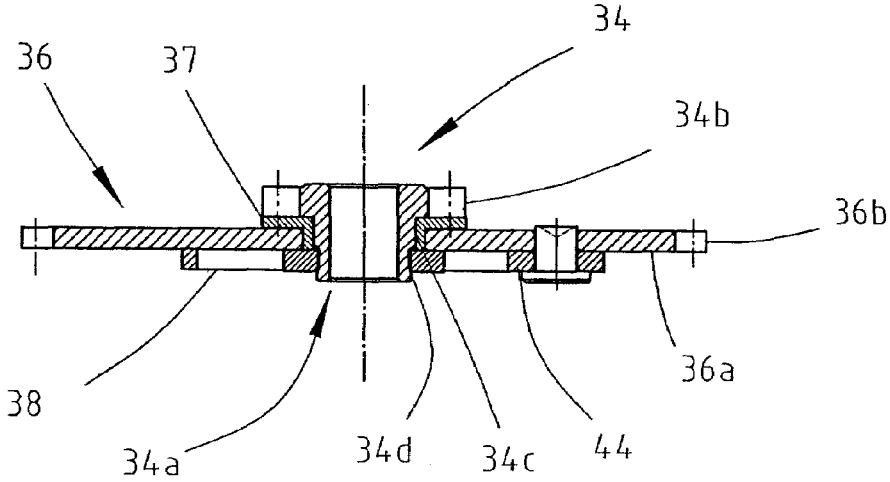

Moreover, the mechanism includes an intermediate wheel set 32, particularly illustrated in FIGS. 2 and 3, mounted so as to pivot on plate 8. It includes a pinion 34 formed of a sleeve 34*a* provided, at one of its ends, with a toothing 34*b*. Sleeve 34*a* is formed of a cylindrical portion 34*c* and a conical portion 34*d* that are enlarged from portion 34*c* outwards.

Wheel set 32 further includes a wheel 36 formed of a plate 36*a* the periphery of which is provided with a toothing 36*b* which meshes with arbour 20 of differential gear 18. A spacer 37 is driven onto portion 34*c* of sleeve 34*a*. A wheel 36 is mounted freely in rotation on spacer 37 and can thus rotate on pinion 34.

According to the invention, a lever 38 of rectangular shape and whose length is around 0.75 times that of the diameter of wheel 36, is provided with a longitudinal slot 41 that enlarges into an opening 42 located approximately at third thirds of its length. Lever 38 thus has, on either side of opening 42, a large arm 38*a* and a small arm 38*b*. It is snap fitted onto the conical part 34*d* of pinion 34 so as to hold wheel 36 axially. Pinion 34 and lever 38 thus form a friction mechanism, whose threshold couple is defined by the elasticity of arms 38*a* and 38*b*.

Moreover, a spring 40 formed of an elastic strip in the shape of an arc of a circle embracing an angle of around 270° is fixed, via one of its ends 44 and in a known manner, to the plate of wheel 36. Its other end 46, which is free, forms an elbow 46*a* bent towards the exterior of the wheel and disposed such that, at rest, it abuts against the large arm 38*a*, in proximity to opening 42 and thus holds the lever pressed against end 44 of the strip.

Finally, FIG. 1 also shows that the mechanism comprises an indicator wheel set 48 mounted so as to pivot on a pivot-shank 50 driven into plate 8. It includes a plate 48*a* provided, at its periphery, with a toothing 48*b* meshed with pinion 34, and a pipe 48*c* extending beyond plate 8 and intended to carry a power reserve indicator hand, which is not shown in the drawing.

Plate 48*a* includes a cut out portion 48*d* in the form of an annular section embracing an angle of around 150° corresponding to the angle of displacement of the hand. A pin 52, driven into plate 8 is engaged in cut out portion 48*d* and acts as a stop for wheel set 48, for which first and second end positions are thus defined.

In a watch movement fitted with the mechanism that has just been described, mainspring 14, while letting down, drives in rotation and in a conventional manner, barrel 10 which meshes with the going train.

The aforecited EP Patent Application describes in detail the operation of differential gear 18 during the winding and letting down of mainspring 14. It will not, therefore, be described again here.

In normal operation, i.e. when the mainspring is sufficiently wound to drive the going train of the movement properly and the indicator wheel set is comprised between its two end positions, spring 40 then drives, via its end 44, lever 38, which is gripped between ends 44 and 46*a* of spring 40.

Figure 4:
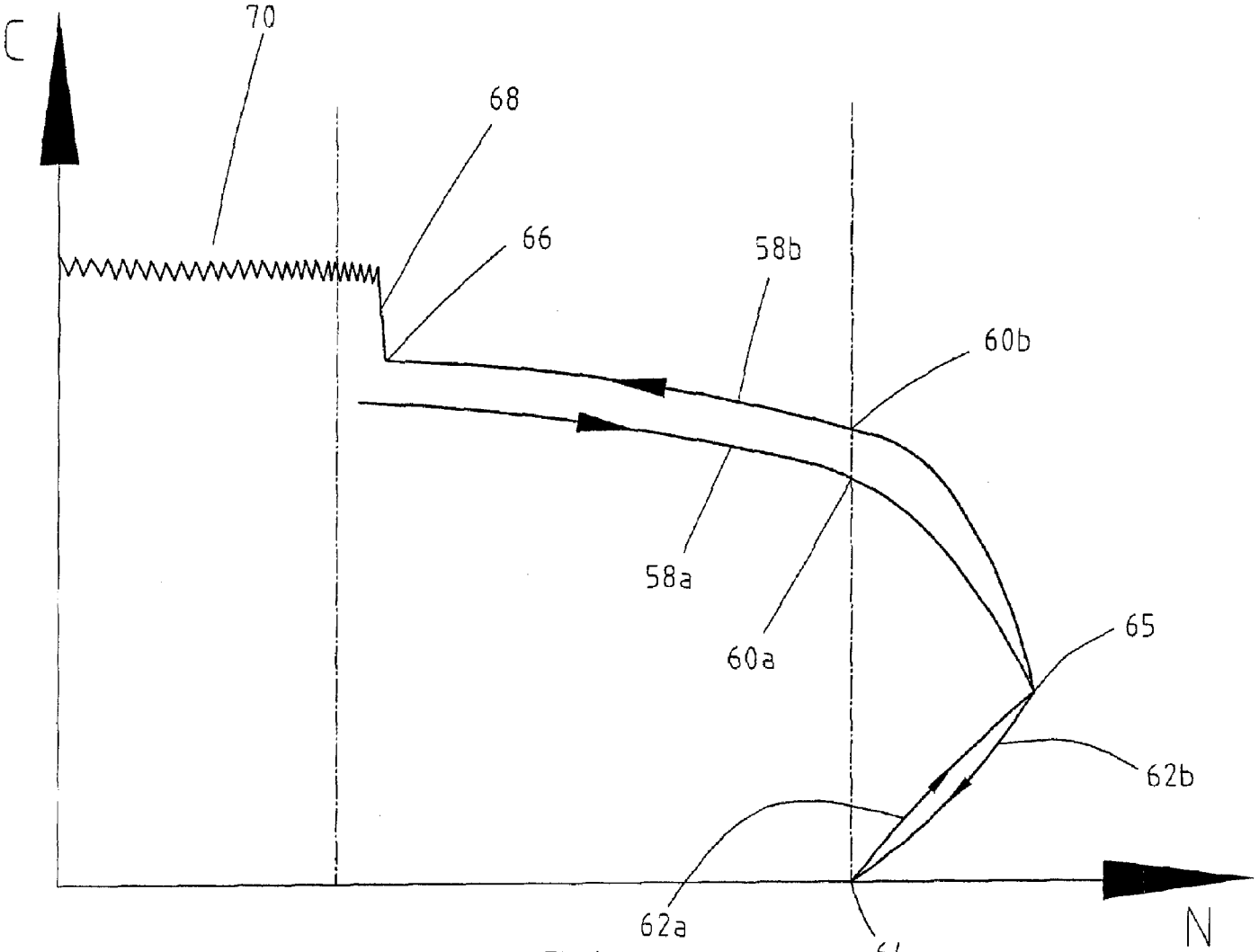
FIG. 4 is a diagram showing the variation in couple as a function of the mainspring winding angle.

Mainspring 14 is slowly let down driving the going train. As can be seen in FIG. 4, the couple of mainspring 14, represented by curve 58*a*, decreases until it reaches a threshold value 60*a*.

The power reserve indicator then indicates that the latter is exhausted and the indicator wheel set is immobilised, the end of cut out portion 48*d* abutting against pin 52.

Like the mechanism described in the aforecited EP document, if the user of the watch still does not wind mainspring 14, the latter continues to be let down while causing the watch movement to work. Differential gear 18 thus continues to rotate and, with it, wheel 36. Since pinion 34 meshes with indicator wheel set 48, it is blocked. Wheel 36 thus has a relative movement in relation to pinion 34. This movement is made possible because wheel 36 is coupled to pinion 34 by spring 40 which is being wound. As curve 62*a* shows, the couple generated by spring 40 increases from point 64 to point 65 where the couple of mainspring 14 and spring 40 compensate for each other, such that the watch stops.

Then, the user winds mainspring 14 illustrated by curve 58*b*. Spring 40 is let down (curve 62*b*), then, when lever 38 returns to its rest position, the mainspring couple reaches a certain value at point 60*b*, the indicator wheel set is again driven and the indicator moves with respect to the scale of the dial. During this operation of winding the mainspring, end 44 of spring 40 drives lever 38 with a lower couple than the friction couple of the lever on the pinion and thus drives, with it, pinion 34. Then, when the power reserve indicator displays the maximum load, the indicator wheel set is immobilised. The corresponding couple of mainspring 14 is shown at point 66 of curve 58*b*. Pinion 34 is then blocked, since it is meshed with the indicator wheel set.

If the user of the watch continues to wind mainspring 14, he must then overcome the friction of lever 38 on sleeve 34*a*, which is illustrated by portion 68 of curve 58*b*. Lever 38, abutting against end 44 of spring 40, thus pivots on pinion 34 until the maximum winding of mainspring 14. Owing to the slipping spring system, the couple of the latter is stabilised at plateau 70, despite the continuing winding. The various elements of the indicator mechanism are thus perfectly adjusted or oriented and correspondence is obtained between the end positions of the lever and the indicator and the maximum winding of the mainspring, without any particular measures having to be taken when the constituent parts of the mechanism are set in place.

The cycle following letting down occurs as described hereinbefore. Then, during the next rewinding, owing to the adjustment achieved during the first cycle, the user knows that when the indicator reaches its end position, the mainspring is completely wound. In the device described, no particular measures are required to set the various components in place, both as regards production and after sales service, since the indicator is automatically adjusted in its correct position, owing to the fact that, during winding, lever 38 rotates with friction on pinion 34, whereas during letting down, the adjustment is maintained, because spring 40 is being wound. It is clear that, in order to allow these arrangements, the winding couple of spring 40 must always remain less than the friction couple of lever 38 on conical portion 34*d*.

The invention claimed is:

1. A power reserve indicator mechanism for a timepiece of the type comprised of a frame, an energy source formed of a barrel and a mainspring housed in the barrel, a going train driven by said barrel, and means for winding said mainspring, said power reserve indicator mechanism comprising:

a power reserve indicator with an indicator wheel set and a display device carried by the indicator wheel set;

a differential gear kinematically coupled by a first input to the barrel, by a second input to the winding means, and by an output to said power reserve indicator; and an intermediate wheel set including first and second parts respectively kinematically coupled to said output and to the indicator wheel set, and a coupling member coupling said first and second parts, arranged such that said power reserve indicator occupies a position comprised between first and a second end positions, the first end position reached when a winding of the mainspring is greater than an upper threshold value, and the second end position when the winding of the mainspring is less than a lower threshold value, said first and second parts rotating conjointly while the winding of the mainspring is comprised between the threshold values, wherein said coupling member includes i) a friction mechanism arranged such that the first part is movable with friction in relation to the second part when the power reserve indicator has reached the first end position, and ii) an elastic element configured to be cockable when the power reserve indicator has reached the second end position by a movement of the first part with reference to the second part, wherein said friction mechanism includes a stop secured to one of the first part and the second part, and said friction mechanism also includes a lever friction mounted on an other of the first part and the second part, and wherein said stop and said lever are disposed and sized such that i) when the power reserve indicator occupies the first end position and the mainspring continues to be wound, said lever is held against said stop and rotates with friction on the other of the first part and the second part to which said lever is secured such that the power reserve indicator remains immobile, and ii) as soon as the mainspring is let down, the power reserve indicator leaves the first end position with the first and second parts of the intermediate wheel set rotating together.

2. The mechanism according to claim 1, wherein said lever is provided with a longitudinal slot that enlarges into an opening to engage on the other of the first part and the second part to which said lever is secured.

3. The mechanism according to claim 1, wherein said elastic element is secured to the one of the first part and the second part including said stop, and cooperates with said lever such that, when said power reserve indicator occupies the second end position, the lever is immobilized, whereas the mainspring drives the going train and said differential gear, and wherein said elastic element is cocked, then let down when the mainspring is being wound.

4. The mechanism according to claim 3, wherein said elastic element is formed of an elastic strip with a first and second end, the elastic strip being fixed via the first end to said one of the first part and the second part including said stop, and the second end is free and disposed such that the second end holds the lever against said first end.

5. The mechanism according to claims claim 1, wherein said intermediate wheel set comprises i) a wheel formed of a plate with a periphery provided with first toothing, ii) a pinion formed of a sleeve, an end of the sleeve provided with a second toothing, and iii) a spacer disposed on the sleeve, wherein said lever is securely mounted on the sleeve to keep said wheel free in rotation on the spacer, and wherein the wheel defines the first part.

6. The mechanism according to claim 1, wherein said mainspring is of a slipping spring type.

7. The mechanism according to claim 2, wherein said elastic element is secured to the one of the first part and the second part including said stop, and cooperates with said lever such that, when said power reserve indicator occupies the second end position, said lever is immobilized, whereas the mainspring drives the going train and said differential gear, and wherein said elastic element is cocked, then let down when the mainspring is being wound.

8. The mechanism according to claim 2, wherein said intermediate wheel set comprises i) a wheel formed of a plate with a periphery provided with first toothing, ii) a pinion formed of a sleeve, an end of the sleeve provided with a second toothing, and iii) a spacer disposed on the sleeve, wherein said lever is securely mounted on the sleeve to keep said wheel free in rotation on the spacer, and wherein the wheel defines the first part.

9. The mechanism according to claim 3, wherein said intermediate wheel set comprises i) a wheel formed of a plate with a periphery provided with first toothing, ii) a pinion formed of a sleeve, an end of the sleeve provided with a second toothing, and iii) a spacer disposed on the sleeve, wherein said lever is securely mounted on the sleeve to keep said wheel free in rotation on the spacer, and wherein the wheel defines the first part.

10. The mechanism according to claim 4, wherein said intermediate wheel set comprises i) a wheel formed of a plate with a periphery provided with first toothing, ii) a pinion formed of a sleeve, an end of the sleeve provided with a second toothing, and iii) a spacer disposed on the sleeve, wherein said lever is securely mounted on the sleeve to keep said wheel free in rotation on the spacer, and wherein the wheel defines the first part.

11. The mechanism according to claim 2, wherein said mainspring is of the slipping spring type.

12. The mechanism according to claim 3, wherein said mainspring is of the slipping spring type.

13. The mechanism according to claim 4, wherein said mainspring is of the slipping spring type.

14. The mechanism according to claim 5, wherein said mainspring is of the slipping spring type.

15. A power reserve indicator mechanism for a timepiece of the type comprised of a frame, an energy source formed of a barrel and a mainspring housed in the barrel, a going train driven by said barrel, and means for winding said mainspring, said power reserve indicator mechanism comprising:

a power reserve indicator with an indicator wheel set and a display device carried by the indicator wheel set;

a differential gear kinematically coupled by a first input to the barrel, by a second input to the winding means, and by an output to said power reserve indicator; and an intermediate wheel set including first and second parts respectively kinematically coupled to said output and to the indicator wheel set, and a coupling member coupling said first and second parts, arranged such that said power reserve indicator occupies a position comprised between first and a second end positions, the first end position reached when a winding of the mainspring is greater than an upper threshold value, and the second end position when the winding of the mainspring is less than a lower threshold value, said first and second parts rotating conjointly while the winding of the mainspring is comprised between the threshold values, wherein said coupling member includes i) a friction mechanism arranged such that the first part is movable with friction in relation to the second part when the power reserve indicator has reached the first end position, and ii) an elastic element configured to be cockable when the power reserve indicator has reached the second end position by a movement of the first part with reference to the second part, wherein said intermediate wheel set comprises i) a wheel formed of a plate with a periphery provided with first toothing, ii) a pinion formed of a sleeve, an end of the sleeve provided with a second toothing, and iii) a spacer disposed on the sleeve, wherein said lever is securely mounted on the sleeve to keep said wheel free in rotation on the spacer, and wherein the wheel defines the first part, and the pinion forms the second part.

16. The mechanism according to claim 15, wherein said mainspring is of the slipping spring type.

* * * * *